US006883472B2

(12) United States Patent
Krotky et al.

(10) Patent No.: US 6,883,472 B2
(45) Date of Patent: Apr. 26, 2005

(54) CYLINDER HEAD FOR A WATER-COOLED MULTI-CYLINDER INTERNAL-COMBUSTION ENGINE

(75) Inventors: Peter Krotky, Simmozheim (DE); Albrecth Reustle, Walheim (DE)

(73) Assignee: Dr. Ing. h.c.F. Porsche Aktiengesellschaft, Stuttgart (DE)

( * ) Notice: Subject to any disclaimer, the term of this patent is extended or adjusted under 35 U.S.C. 154(b) by 0 days.

(21) Appl. No.: 10/812,981

(22) Filed: Mar. 31, 2004

(65) Prior Publication Data

US 2004/0177818 A1 Sep. 16, 2004

Related U.S. Application Data

(63) Continuation of application No. PCT/EP03/06307, filed on Jun. 14, 2003.

(30) Foreign Application Priority Data

Aug. 16, 2002 (DE) ..... 102 37 664

(51) Int. Cl.[7] ..... F02F 1/38
(52) U.S. Cl. ..... 123/41.82 R
(58) Field of Search ..... 123/41.82 R, 41.74, 123/41.72, 41.76, 41.77, 193.5

(56) References Cited

U.S. PATENT DOCUMENTS 4,699,092 A 10/1987 Ruf et al.
5,890,461 A 4/1999 Iikura
6,427,642 B1 8/2002 Beer et al.
6,499,444 B1 12/2002 Batzill et al.
6,681,727 B1 * 1/2004 Krenn ..... 123/41.82 R
2002/0162520 A1 11/2002 Batzill

FOREIGN PATENT DOCUMENTS

| | | |
|---|---|---|
| DE | 35 16 453 | 7/1989 |
| DE | 196 08 576 | 6/1997 |
| DE | 199 43 001 | 10/2000 |
| DE | 100 21 525 | 11/2001 |
| EP | 1 083 329 | 3/2001 |

* cited by examiner

*Primary Examiner*—Willis R. Wolfe
*Assistant Examiner*—Hyder Ali
(74) *Attorney, Agent, or Firm*—Crowell & Moring LLP

(57) ABSTRACT

A cylinder head for a water-cooled multi-cylinder internal-combustion engine has two intake valves and outlet valves per cylinder. A cylinder head cooling chamber has inflow and outflow openings for coolant as well as a receiving opening for a spark plug. The receiving opening is arranged centrally relative to the cylinder head cooling chamber of a cylinder. On the inflow side in the cylinder head cooling chamber, a main cooling flow runs between the two outlet valves in the direction of the receiving opening for the spark plug, while two secondary cooling flows are provided at the two edge areas of the inflow side.

17 Claims, 3 Drawing Sheets

CYLINDER HEAD FOR A WATER-COOLED MULTI-CYLINDER INTERNAL-COMBUSTION ENGINE

BACKGROUND AND SUMMARY OF THE INVENTION

This application is a continuation of International Patent Application No. PCT/EP03/06307 filed on Jun. 14, 2003, designating the United States of American, the entire disclosure of which is incorporated herein by reference. Priority is claimed based on Federal Republic of Germany Patent Application No. DE 102 37 664.6 filed Aug. 16, 2002.

The invention relates to a cylinder head for a water-cooled multi-cylinder internal-combustion engine having two intake valves and outlet valves per cylinder, a cylinder head cooling chamber with inflow and outflow openings for the coolant, and a receiving opening for a spark plug, which receiving opening is arranged centrally relative to the cylinder head cooling chamber of a cylinder.

In German Patent Document DE 100 21 525 A (corresponding U.S. published application US 2002-162520), the cooling circuit for a multi-cylinder internal-combustion engine is illustrated and described, in the case of which, for a coolant flow distribution which meets the demands, approximately ⅔ of the coolant flow caused to circulate for cooling the engine are guided through the cylinder head housing. So that all cylinder head units are uniformly cooled, it is also provided that, relative to the longitudinal axis of the cylinder bank, coolant flows transversely through the cylinder head housing. These are measures for permitting the removal of the high radiant heat generated during the combustion from the cylinder head housing. From German Patent Document DE 199 43 001 C1 (corresponding U.S. Pat. No. 6,499,444), it is also known to cool a hot point in the cylinder head by an additional duct which is aimed at the hot point and carries cooling water. Furthermore, it is known from German Patent Document DE 35 16 453 C2 (corresponding U.S. Pat. No. 4,699,092) to steer the cooling liquid flow by means of ribs arranged in the cylinder head in the direction of a spark plug dome.

It is an object of the invention to provide further measures in order to effectively and uniformly cool the high-temperature-stressed areas of the cylinder head in a targeted manner.

According to the invention, this object is achieved by providing a cylinder head for a water-cooled multi-cylinder internal-combustion engine having two intake valves and outlet valves per cylinder, a cylinder head cooling chamber with inflow and outflow openings for the coolant, and a receiving opening for a spark plug, which receiving opening is arranged centrally relative to the cylinder head cooling chamber of a cylinder, wherein on an inflow side in the cylinder head cooling chamber, a main cooling flow runs between the two outlet valves in the direction of the receiving opening for the spark plug, while two secondary cooling flows are provided at two edge areas of the inflow side.

As a result of the characteristics of the invention as described in the preceding paragraph, a cooling adapted to the temperature load in the cylinder head is achieved inside the cylinder head of a multi-cylinder internal-combustion engine, during which cooling, a main coolant flow is guided between the two outlet valves of the four-valve engine in the direction of the spark plug dome, while the edge zones of the cylinder head cooling chambers are supplied with secondary cooling flows.

Additional advantageous embodiments and improvements of the cylinder head according to preferred embodiments of the invention for a water-cooled multi-cylinder internal-combustion engine are described below and in the claims.

According to certain preferred embodiments of the invention, as a result of the guiding ribs provided at the level of the receiving opening for the spark plug, the coolant is advantageously guided into the area of the high-temperature-stressed spark plug dome. As a result of the fact that the cross-sections of the two guiding ribs have different constructions, a transverse flow is generated behind the guiding ribs which counteracts the formation of so-called dead water regions and contributes to the fact that a sufficient coolant supply exists also in the area of the intake valves.

According to certain preferred embodiments of the invention, as a second measure for generating a transverse flow in the rearward area of the intake valves—viewed in the flow direction of the coolant—, it is suggested that diameters of the outflow openings have different sizes.

According to certain preferred embodiments of the invention, for aiding the cooling of the hot point existing in the spark plug dome area, a cooling duct is additionally provided on the inflow side in the cylinder head, which cooling duct guides coolant directly to the hot point.

Other objects, advantages and novel features of the present invention will become apparent from the following detailed description of the invention when considered in conjunction with the accompanying drawings.

DETAILED DESCRIPTION OF THE DRAWINGS

The figures show the geometry of a water jacket—in the following called cylinder head cooling chamber 2—of a cylinder for a multi-cylinder internal-combustion engine, as it is described, for example, in German Patent Document DE 100 21 525 A1. The cylinder head cooling chamber 2 of each cylinder is supplied with cooling water by way of two inflow openings 4 and 6 provided in the cylinder head housing. On the opposite side of the cylinder head cooling chamber 2, two outflow openings 8 and 10 are provided by way of which the coolant heated by the cylinder head flows off toward the suction side of the water pump, which is not shown, of the internal-combustion engine.

Figure 1:
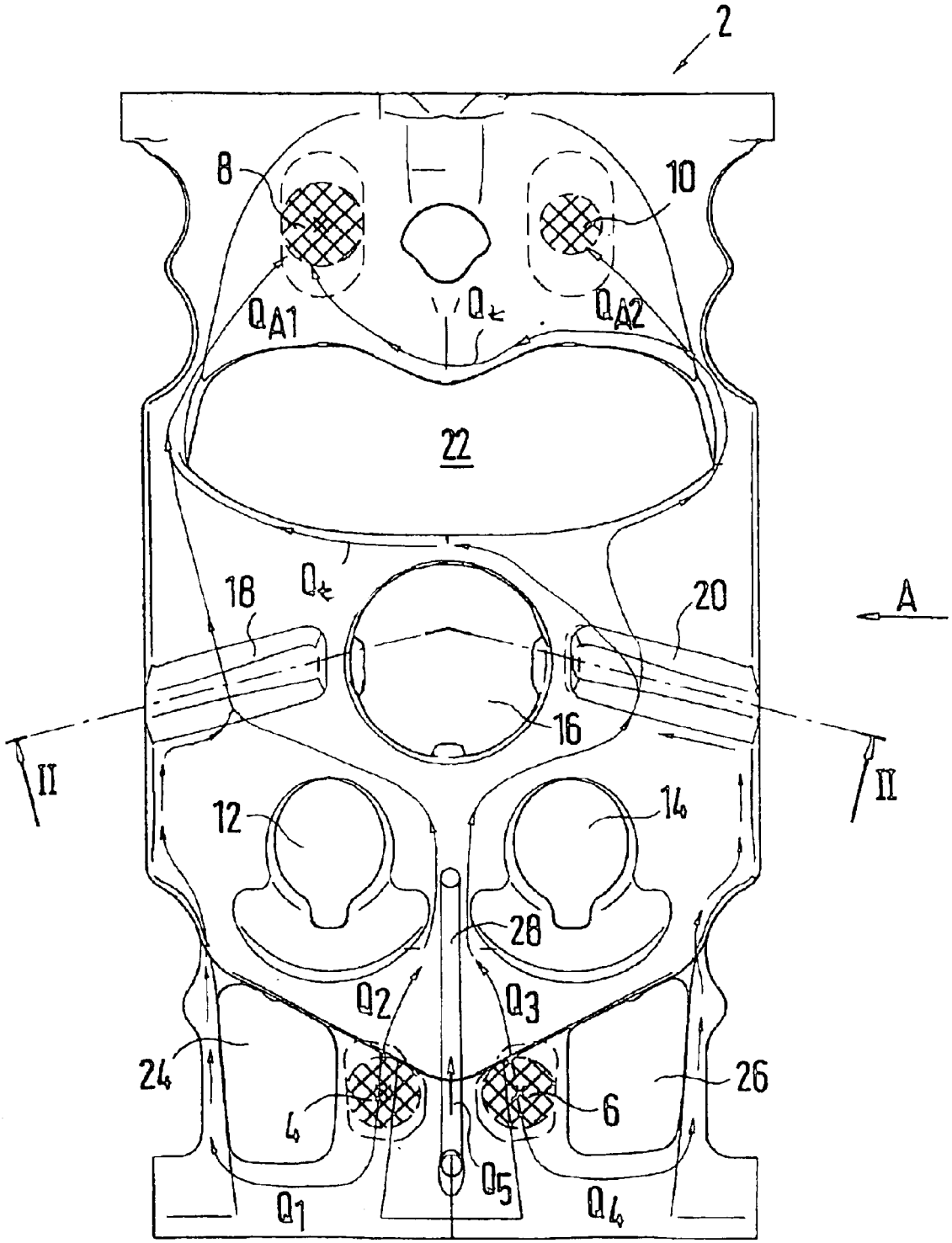
FIG. 1 is a geometrical representation of a water jacket in the cylinder head housing of an internal-combustion engine, constructed according to a preferred embodiment of the invention.
Figure 2:
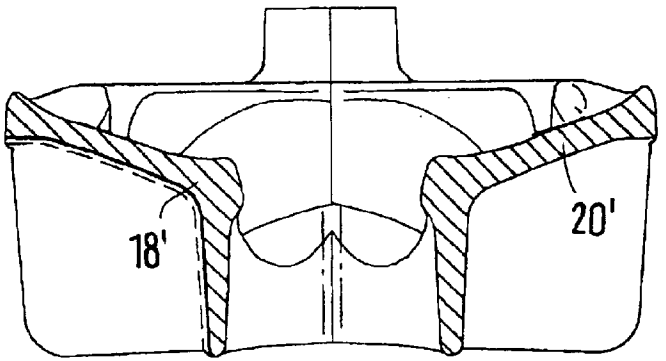
FIG. 2 is a sectional view along Line II—II in FIG. 1.
Figure 3:
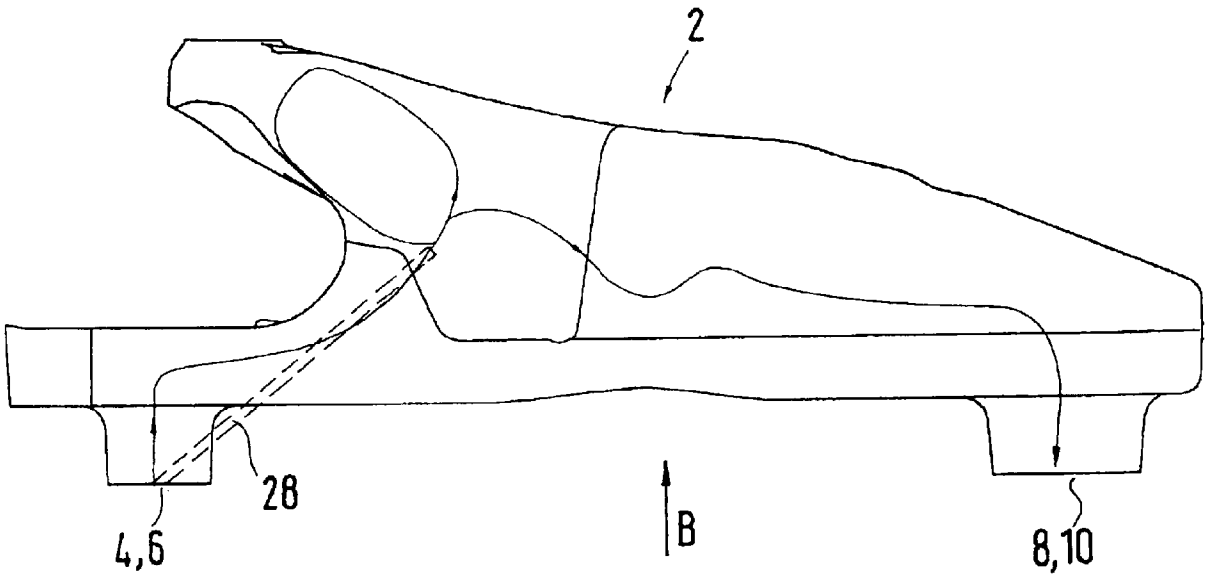
FIG. 3 is a lateral view of the water jacket in the direction of the arrow A in FIG. 1.
Figure 4:
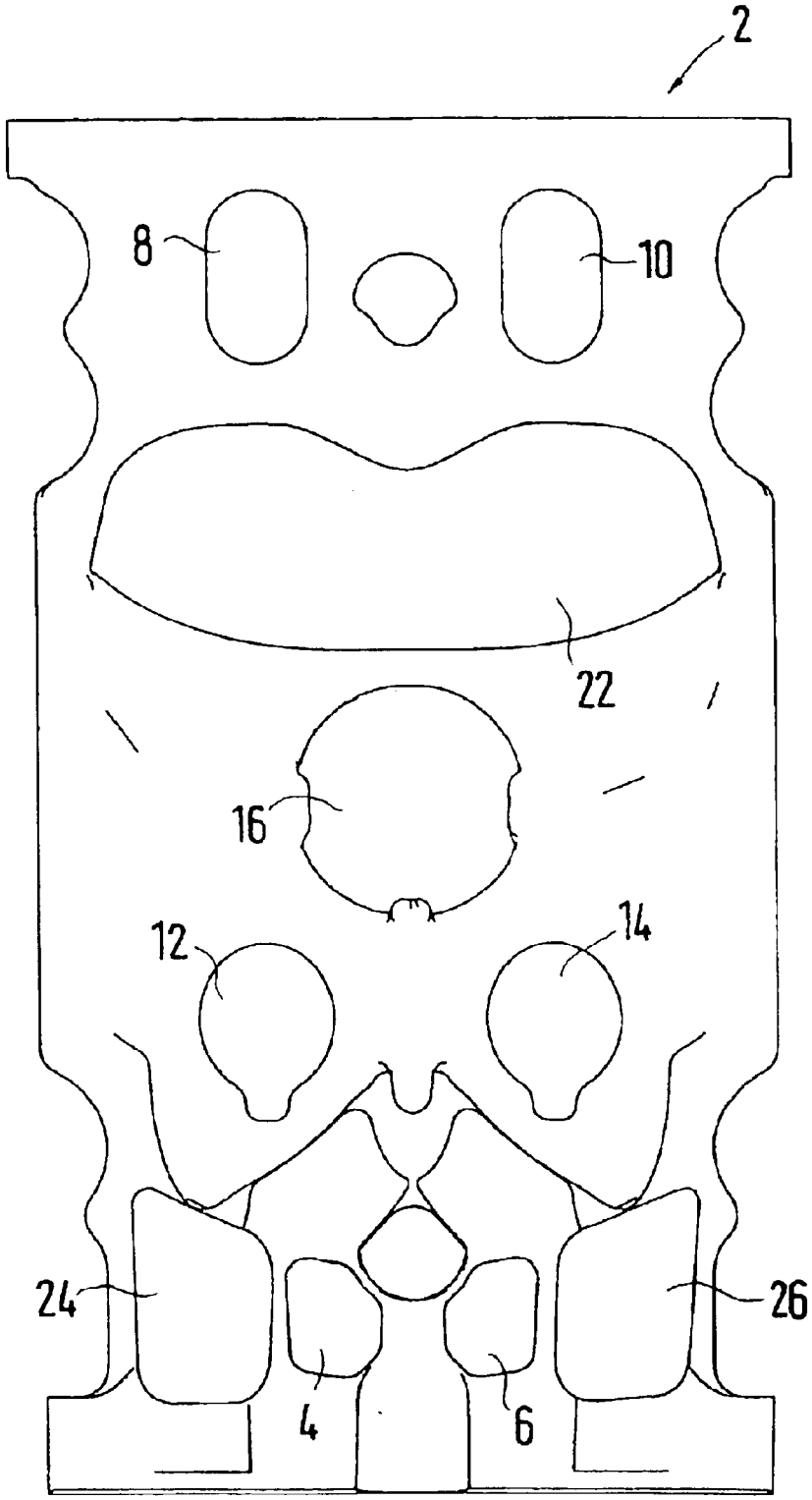
FIG. 4 is a view of the water jacket from direction B in FIG. 3.

In the geometrical representation of the cylinder head cooling chamber 2, two recesses 12 and 14 are visible for the two intake valves of the internal-combustion engine. An opening 16 centrally provided in the cylinder head cooling chamber 2 forms the receiving device or the dome for the spark plug of the respective cylinder. On the left and right of the central opening 16, two rib-shaped recesses 18 and 20 are provided which are constructed in the cylinder head housing with two guiding ribs 18' and 20'. As illustrated in FIG. 2, the constructions of the cross-sections of the two guiding ribs 18' and 20' have different sizes. The function of this further development will be described in detail below.

Viewed in the flow direction of the coolant, a recess 22 for the two intake valves of the cylinder head follow the two recesses 18, 20 and the central opening 16.

On the inflow side of the coolant, two additional recesses 24 and 26 are visible in the cylinder head cooling chamber 2 formed by two aluminum webs arranged in the cylinder head housing. A bore 28 extending between the two inflow openings 4, 6 and between the two recesses 12, 14 in the cylinder head is used for the direct feeding of coolant to the hot point which, generated by the combustion chamber of the cylinder head housing, is formed in the area of the spark plug dome (wall of the spark plug receiving device).

The inflow side of the cylinder head cooling chamber 2 is constructed such that, by way of the inflow openings 4 and 6, a main cooling flow $Q_2$ and $Q_3$ is guided between the two outlet valves (recess 12, 14) in the direction of the spark plug dome (central opening 16), while in the respective left and right edge area of the cylinder head cooling chamber 2, a secondary cooling flow $Q_1$ and $Q_4$ is formed which is guided along by way of the two outflow openings 4 and 6 on the exterior side of the two recesses 24 and 26 in the direction of the ribs 18' and 20'. As illustrated by means of arrows, the cooling flows $Q_2$ and $Q_3$, as a result of the spark plug dome, are directed in the direction of the guiding ribs 18' and 20', where they meet with the cooling flows $Q_1$ and $Q_4$. As a result of the fact that the cross-section of the guiding rib 18' is smaller than that of the guiding rib 20', and that the diameter of the outflow opening 8 is larger than the diameter of the outflow opening 10, a transverse flow $Q_t$ is generated in the area of the intake valves (see recess 22) and contributes to an optimal cooling of the cylinder head housing in this area, and thus prevents the formation of so-called dead water regions.

In addition to these measures, as a result of the cooling flow $Q_5$ generated by the cooling duct 28, coolant is guided directly to a hot point in the cylinder head housing which is formed in the wall area of the combustion chamber at the level of the spark plug dome which surrounds the opening or the thread for receiving the spark plug.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Cylinder head for a water-cooled multi-cylinder internal-combustion engine having two intake valves and outlet valves per cylinder, a cylinder head cooling chamber with inflow and outflow openings for the coolant, and a receiving opening for a spark plug, which receiving opening is arranged centrally relative to the cylinder head cooling chamber of a cylinder, wherein on an inflow side in the cylinder head cooling chamber, a main cooling flow runs between the two outlet valves in a direction of the receiving opening for the spark plug, while two secondary cooling flows are provided at two edge areas of the inflow side, and wherein at the level of the receiving opening for the spark plug, two guiding ribs are provided laterally of the opening, whose cross-sections have different sizes for generating a transverse flow.

2. Cylinder head according to claim 1, wherein on the outflow side of the cylinder head cooling chamber, two outflow openings are provided whose diameters have different sizes for generating a transverse flow.

3. Cylinder head according to claim 2, wherein a cooling duct is additionally provided on the inflow side which directly guides coolant to a hot spot in the cylinder head housing.

4. Cylinder head according to claim 1, wherein a cooling duct is additionally provided on the inflow side which directly guides coolant to a hot spot in the cylinder head housing.

5. Cylinder head for a water-cooled multi-cylinder internal-combustion engine having two intake valves and outlet valves per cylinder, a cylinder head cooling chamber with inflow and outflow openings for the coolant, and a receiving opening for a spark plug, which receiving opening is arranged centrally relative to the cylinder head cooling chamber of a cylinder, wherein on an inflow side in the cylinder head cooling chamber, a main cooling flow runs between the two outlet valves in a direction of the receiving opening for the spark plug, while two secondary cooling flows are provided at two edge areas of the inflow side, and wherein on the outflow side of the cylinder head cooling chamber, two outflow openings are provided whose diameters have different sizes for generating a transverse flow.

6. Cylinder head according to claim 5, wherein a cooling duct is additionally provided on the inflow side which directly guides coolant to a hot spot in the cylinder head housing.

7. Cylinder head for a water-cooled multi-cylinder internal combustion engine of the type having two outlet valves per cylinder, said cylinder head comprising:

an ignition plug receiving opening, a pair of outlet valve accommodating recesses at one side of the receiving opening, and a cylinder head cooling chamber with inflow and outflow openings for a coolant, wherein said cooling chamber is configured to provide a main cooling flow between the outlet valve accommodating recesses and secondary cooling flows alone lateral sides of the outlet valve accommodating recesses, and wherein a pair of coolant inflow openings are provided at a side of said outlet valve accommodating recesses facing away from the ignition plug receiving opening.

8. Cylinder head according to claim 7, wherein coolant guiding ribs with different cross-sectional sizes are provided in the cooling chamber at respective opposite sides of the ignition plug receiving opening, to thereby generate a transverse flow of coolant.

9. Cylinder head according to claim 8, wherein said cooling chamber has first and second outflow openings with different sizes to thereby generate a transverse flow of coolant.

10. Cylinder head according to claim 9, wherein said cooling chamber includes a further cooling inlet between the inflow openings, which further cooling inlet directly guides coolant to a hot spot in the cylinder head.

11. Cylinder head according to claim 8, wherein said cooling chamber includes a further cooling inlet between the inflow openings, which further cooling inlet directly guides coolant to a hot spot in the cylinder head.

12. Cylinder head according to claim 7, wherein said cooling chamber has first and second outflow openings with different sizes to thereby generate a transverse flow of coolant.

13. Cylinder head according to claim 12, wherein said cooling chamber includes a further cooling inlet between the inflow openings, which further cooling inlet directly guides coolant to a hot spot in the cylinder head.

14. Cylinder head according to claim 7, wherein said cooling chamber includes a further cooling inlet between the inflow openings, which further cooling inlet directly guides coolant to a hot spot in the cylinder head.

15. Cylinder head for a water-cooled multi-cylinder internal combustion engine of the type having two outlet valves per cylinder, said cylinder head comprising:

an ignition plug receiving opening, a pair of outlet valve accommodating recesses at one side of the receiving opening, and a cylinder head cooling chamber with inflow and outflow openings for a coolant, wherein said cooling chamber is configured to provide a main cooling flow between the outlet valve accommodating recesses and secondary cooling flows along lateral sides of the outlet valve accommodating recesses, and wherein coolant guiding ribs with different cross-sectional sizes are provided in the cooling chamber at respective opposite sides of the ignition plug receiving opening, to thereby generate a transverse flow of coolant.

16. Cylinder head according to claim 15, wherein said cooling chamber has first and second outflow openings with different sizes to thereby generate a transverse flow of coolant.

17. Cylinder head for a water-cooled multi-cylinder internal combustion engine of the type having two outlet valves per cylinder, said cylinder head comprising:

an ignition plug receiving opening, a pair of outlet valve accommodating recesses at one side of the receiving opening, and a cylinder head cooling chamber with inflow and outflow openings for a coolant, wherein said cooling chamber is configured to provide a main cooling flow between the outlet valve accommodating recesses and secondary cooling flows along lateral sides of the outlet valve accommodating recesses, and wherein said cooling chamber has first and second outflow openings with different sizes to thereby generate a transverse flow of coolant.

* * * * *